US011350771B2

(12) United States Patent
Washington

(10) Patent No.: US 11,350,771 B2
(45) Date of Patent: Jun. 7, 2022

(54) SYSTEMS AND METHODS FOR SUPPORTING AND DISPLAYING ELONGATE UTENSILS

(71) Applicant: Shirley Ann Washington, St. Louis, MO (US)

(72) Inventor: Shirley Ann Washington, St. Louis, MO (US)

(73) Assignee: Shirley Ann Washington, St. Louis, MO (US)

( * ) Notice: Subject to any disclaimer, the term of this patent is extended or adjusted under 35 U.S.C. 154(b) by 0 days.

(21) Appl. No.: 16/755,073

(22) PCT Filed: Dec. 2, 2019

(86) PCT No.: PCT/US2019/063951
§ 371 (c)(1),
(2) Date: Apr. 9, 2020

(87) PCT Pub. No.: WO2020/117648
PCT Pub. Date: Jun. 11, 2020

(65) Prior Publication Data

US 2021/0289957 A1 Sep. 23, 2021

Related U.S. Application Data

(60) Provisional application No. 62/807,688, filed on Feb. 19, 2019, provisional application No. 62/774,375, filed on Dec. 3, 2018.

(51) Int. Cl.
*A47F 7/00* (2006.01)
*A47F 5/00* (2006.01)

(52) U.S. Cl.
CPC ..... *A47F 7/0028* (2013.01); *A47F 5/0018* (2013.01)

(58) Field of Classification Search
CPC .... A47F 7/0028; A47F 5/0018; A47F 7/0021; A47F 7/0078; A47F 5/16; A47F 7/00;
(Continued)

(56) References Cited

U.S. PATENT DOCUMENTS 387,280 A * 8/1888 Bruce ..... B43L 25/10 211/69.4
893,355 A * 7/1908 McIntyre ..... A47F 5/112 211/69.9

(Continued)

OTHER PUBLICATIONS

International Search Report and Written Opinion, dated Feb. 14, 2020, for International application No. PCT/US2019/063951.

*Primary Examiner* — Devin K Barnett
(74) *Attorney, Agent, or Firm* — Armstrong Teasdale LLP

(57) ABSTRACT

A display system for supporting a plurality of elongate utensils includes a base defining a flat base surface and a longitudinal axis normal to the base surface. An outer shell includes an outer body coupled to the base and extends longitudinally therefrom. The outer body defines a plurality of outer openings extending therethrough, each sized to slidably receive therethrough an elongate utensil. An inner shell includes an inner body coupled to the base, the inner body spaced apart from and at least partially contained within the outer shell. The inner body defines a plurality of inner openings each aligned with a corresponding one of the outer openings along a respective insertion axis of a plurality of insertion axes and sized to slidably receive the elongate utensil. The plurality of insertion axes are oriented at a plurality of different angles relative to the longitudinal axis.

16 Claims, 16 Drawing Sheets

(58) Field of Classification Search

CPC ..... A47F 7/0035; A47F 7/005; A47F 7/0064; A47F 7/0071; A47F 7/02; A47F 7/021; A47G 21/14; A47G 21/145; A47G 21/12; A47B 81/005; A47B 81/007; A47B 47/00; A47B 47/0091; A47B 47/047; A47B 75/00; A47B 81/04; A47B 81/02; A47B 81/00; A47J 47/16; A47J 36/18; A47J 45/00; A47J 47/00

USPC ..... 211/60.1, 69.1, 65, 69

See application file for complete search history.

(56) References Cited

U.S. PATENT DOCUMENTS

D39,437 S * 8/1908 McIntyre ..... D6/682.2
1,092,156 A * 4/1914 Mathis ..... A61L 2/00 206/207
1,647,154 A * 11/1927 Soybel ..... A47F 5/112 211/70.1
D82,173 S * 9/1930 Osbrink ..... D11/147
1,775,250 A * 9/1930 Link ..... A47G 7/07 47/41.13
1,868,802 A * 7/1932 Okai ..... A47G 7/03 47/41.13
2,060,005 A * 11/1936 Fletcher ..... F21V 33/0028 47/41.11
2,062,684 A * 12/1936 Thomas ..... A47G 7/06 47/41.1
D117,334 S * 10/1939 Fuld ..... D11/147
2,226,950 A * 12/1940 Simpson ..... A47G 7/006 47/41.13
D126,210 S * 4/1941 Muhl ..... D11/147
2,332,352 A * 10/1943 Smith ..... A47G 7/07 47/41.13
D145,868 S * 11/1946 Fletcher ..... D11/147
2,747,333 A * 5/1956 Erbguth ..... A47G 7/07 47/41.13
2,981,033 A * 4/1961 Cheetwood ..... A01G 5/04 47/41.12
3,084,788 A 4/1963 Ford
3,104,605 A 9/1963 McKinney
3,158,524 A * 11/1964 Tong ..... A41G 1/00 206/423
3,336,697 A * 8/1967 Davis ..... A01G 5/04 47/41.12
3,745,702 A * 7/1973 Ogawa ..... A47G 7/07 47/41.13
3,827,820 A 8/1974 Hoffman
D262,121 S * 12/1981 Brady ..... D11/158
4,606,950 A * 8/1986 Corbet ..... A01G 5/04 156/63
4,937,109 A * 6/1990 Lin ..... A01G 5/04 248/27.8
4,958,461 A * 9/1990 Aldrich ..... A47G 7/02 47/41.01
4,966,288 A 10/1990 Kirkham
5,064,077 A 11/1991 Mitchell
5,244,700 A * 9/1993 Banschick ..... A01G 5/04 211/13.1
5,297,677 A * 3/1994 Burian ..... A47K 1/09 206/362
D348,415 S * 7/1994 Domurat ..... D11/147
D353,064 S * 12/1994 Gilbert ..... D1/105
5,617,960 A * 4/1997 Bishop ..... A47B 97/02 211/44
5,755,325 A 5/1998 Willhite et al.
5,755,419 A * 5/1998 Gearhart ..... A63H 27/10 248/176.1
5,887,513 A 3/1999 Fielding et al.
D417,239 S * 11/1999 Sullivan ..... D19/82
6,168,030 B1 * 1/2001 Morris ..... A47F 7/0028 211/13.1
6,250,480 B1 * 6/2001 McGuinness ..... A47B 81/005 211/70.6
D446,749 S * 8/2001 Graves ..... D11/147
D458,639 S * 6/2002 Anderson ..... D19/82
6,398,045 B1 * 6/2002 Chao ..... A47F 7/0028 211/181.1
6,457,593 B1 * 10/2002 Hsu ..... A47F 5/02 211/163
6,474,224 B1 11/2002 Natter
D564,938 S * 3/2008 Schissler ..... D11/147
D598,322 S * 8/2009 Kunz ..... D11/147
8,069,609 B1 * 12/2011 Towne ..... A47G 7/06 47/41.12
8,152,588 B2 * 4/2012 Hua ..... A63H 27/10 446/220
D719,481 S * 12/2014 Carter ..... D11/153
D728,694 S * 5/2015 Nelson ..... D21/453
9,629,486 B2 * 4/2017 Allan ..... A01G 5/04
D810,198 S * 2/2018 Azar ..... D19/90
D862,138 S * 10/2019 Povitz ..... D6/682.2
D864,785 S * 10/2019 Wimbush, Sr. ..... D11/143
D873,705 S * 1/2020 Horn ..... D11/147
D878,094 S * 3/2020 Lawrence ..... D6/552
D893,345 S * 8/2020 Mueller ..... D11/146
D918,769 S * 5/2021 Yun ..... D11/143
D925,767 S * 7/2021 Rapier ..... D24/230
2008/0047440 A1 2/2008 Carlson
2009/0272703 A1 * 11/2009 Conway, Jr. ..... A47F 3/14 211/85.4
2010/0242742 A1 9/2010 Teng
2021/0186096 A1 * 6/2021 Mansour ..... A47F 3/001

* cited by examiner

SYSTEMS AND METHODS FOR SUPPORTING AND DISPLAYING ELONGATE UTENSILS

CROSS REFERENCE TO RELATED APPLICATIONS

This application claims priority from U.S. Provisional Application No. 62/807,688, filed on Feb. 19, 2019, and U.S. Provisional Application No. 62/774,375, filed on Dec. 3, 2018, both of which are hereby incorporated herein by reference in their entirety.

BACKGROUND

The field of the disclosure relates generally to display systems and, more particularly, to a system for supporting and displaying elongate utensils, such as skewers for holding food items.

At least some known food display and support systems include skewer utensils including a piercing end for puncturing food items, such as, but not limited to meats, fruits, vegetables, and desserts. At least some such systems generally present the skewer utensils for consumption by placing the skewer utensils generally horizontally on a plate. In particular, at least some such systems primarily use the skewer utensils for grilling, roasting, or frying the skewered food items on the skewer. As a result, at least some such food display support systems are not well suited to display and serve the food items in an upright, easy to access, and/or visually appealing position.

Additionally, at least some other known food display and support systems enable, at least partially, vertical support of food skewers. For example, at least some such systems include skewers configured to be hung from a rod or received within a flat holder. However, such systems are generally configured to support the skewers vertically and are not configured for positioning the skewers at varying angles relative to one another in a visually appealing arrangement. Moreover, at least some such systems generally require that a user vertically lift and/or lower a food skewer to remove it from the holder/and or utensils, thereby placing the user in close proximity to adjacent food skewers when inserting/removing an individual skewer from the holders and/or hangers. As a result, at least some such systems are not well suited to preventing contact between a user and food items positioned on an adjacent skewer during use. Moreover, at least some known food display and support systems include foam mounts configured to receive skewered utensils therein. However, at least some such systems are difficult to clean, and the puncture holes in the foam material may degrade the foam material, thereby limiting reusability of such systems.

BRIEF DESCRIPTION

In one aspect, a display system for supporting a plurality of elongate utensils is provided. The display system includes a base defining a flat base surface and a longitudinal axis normal to the base surface. The display system also includes an outer shell including an outer body coupled to the base and extending longitudinally therefrom. The outer body defines a plurality of outer openings extending therethrough, each sized to slidably receive therethrough an elongate utensil. The display system further includes an inner shell including an inner body coupled to the base, the inner body spaced apart from and at least partially contained within the outer shell. The inner body defines a plurality of inner openings each aligned with a corresponding one of the outer openings along a respective insertion axis of a plurality of insertion axes and sized to slidably receive the elongate utensil. The plurality of insertion axes are oriented at a plurality of different angles relative to the longitudinal axis.

In another aspect, a display system for supporting a plurality of elongate utensils is provided. The display system includes a base defining a flat base surface and a longitudinal axis normal to the base surface. The display system also includes an outer shell including an outer body coupled to the base and extending longitudinally therefrom. The outer body defines a first outer opening extending therethrough and sized to slidably receive therethrough a first elongate utensil of the plurality of elongate utensils along a first insertion axis. The outer body further defining a second outer opening sized to slidably receive a second elongate utensil of the plurality of elongate utensils along a second insertion axis. The display system further includes an inner shell including an inner body coupled to the base, the inner body spaced apart from and at least partially contained within the outer shell. The inner body defines a first inner opening aligned with the first outer opening along the first insertion axis and sized to slidably receive the first elongate utensil. The inner shell further includes a second inner opening aligned with the second outer opening along the second insertion axis and sized to slidably receive the second elongate utensil. The first insertion axis is oriented at a first angle relative to the longitudinal axis and the second insertion axis is oriented at a second, different angle relative to the longitudinal axis.

In yet another aspect, a method of assembling a display system for supporting a plurality of elongate utensils is provided. The method includes coupling, to a base, an inner shell including an inner body defining a first inner opening sized to slidably receive a first elongate utensil of a plurality of elongate utensils therethrough along a first insertion axis. The inner body further defines a second inner opening sized to slidably receive a second elongate utensil of the plurality of elongate utensils therethrough along a second insertion axis. The base defines a flat base surface and a longitudinal axis normal to the base surface. The method further includes coupling, to the base, an outer shell including an outer body. The outer body defines a first outer opening extending through the outer body and sized to slidably receive the first elongate utensil therethrough along the first insertion axis. The outer body further defines a second outer opening sized to slidably receive the second elongate utensil therethrough along the second insertion axis. The inner shell is spaced apart from and at least partially contained within the outer shell and the outer shell is oriented on the base such that the first inner opening is aligned with the first outer opening along the first insertion axis and the second inner opening is aligned with the second outer opening along the second insertion axis. The first insertion axis is oriented at a first angle relative to the longitudinal axis and the second insertion axis is oriented at a second, different angle relative to the longitudinal axis.

The features, functions, and advantages described herein may be achieved independently in various embodiments of the present disclosure or may be combined in yet other embodiments, further details of which may be seen with reference to the following description and drawings.

DETAILED DESCRIPTION

The embodiments described herein include a base defining a flat base surface and a longitudinal axis oriented normal to the base surface. An outer shell including an outer body is coupled to the base surface and extends longitudinally therefrom. An inner shell including an inner body is coupled to the base and is spaced apart from, and at least partially contained within the outer shell. The outer body defines outer openings extending through the outer body and sized to slidably receive elongate utensils along respective insertion axes. The insertion axes are oriented at various angles relative to the longitudinal axis. The inner body defines inner openings aligned with the outer openings along the respective insertion axes and sized to slidably receive the elongate utensils along the respective insertion axes. The aligned cooperating openings in the inner and outer shells provide structural support for the utensils, enabling them to support, for example, pieces of food items skewered on the utensils in a stable, visually appealing arrangement. The respective insertion axes may be configured to spread the inserted skewers in a bouquet-type arrangement, facilitating the selection and removal of utensils and accompanying food items with reduced or no contact with adjacent skewered food items. In addition, the inner and outer shells may be formed from a rigid plastic or other material which is easy to clean (e.g., in a dishwashing medium) and does not degrade over many repeated insertions/removal of the utensils. Additionally or alternatively, the system includes a setting platform configured to be positioned on a support surface and defining a recess within the setting platform to hold the base. The setting platform may be decorative as well as functional.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

Figure 1:
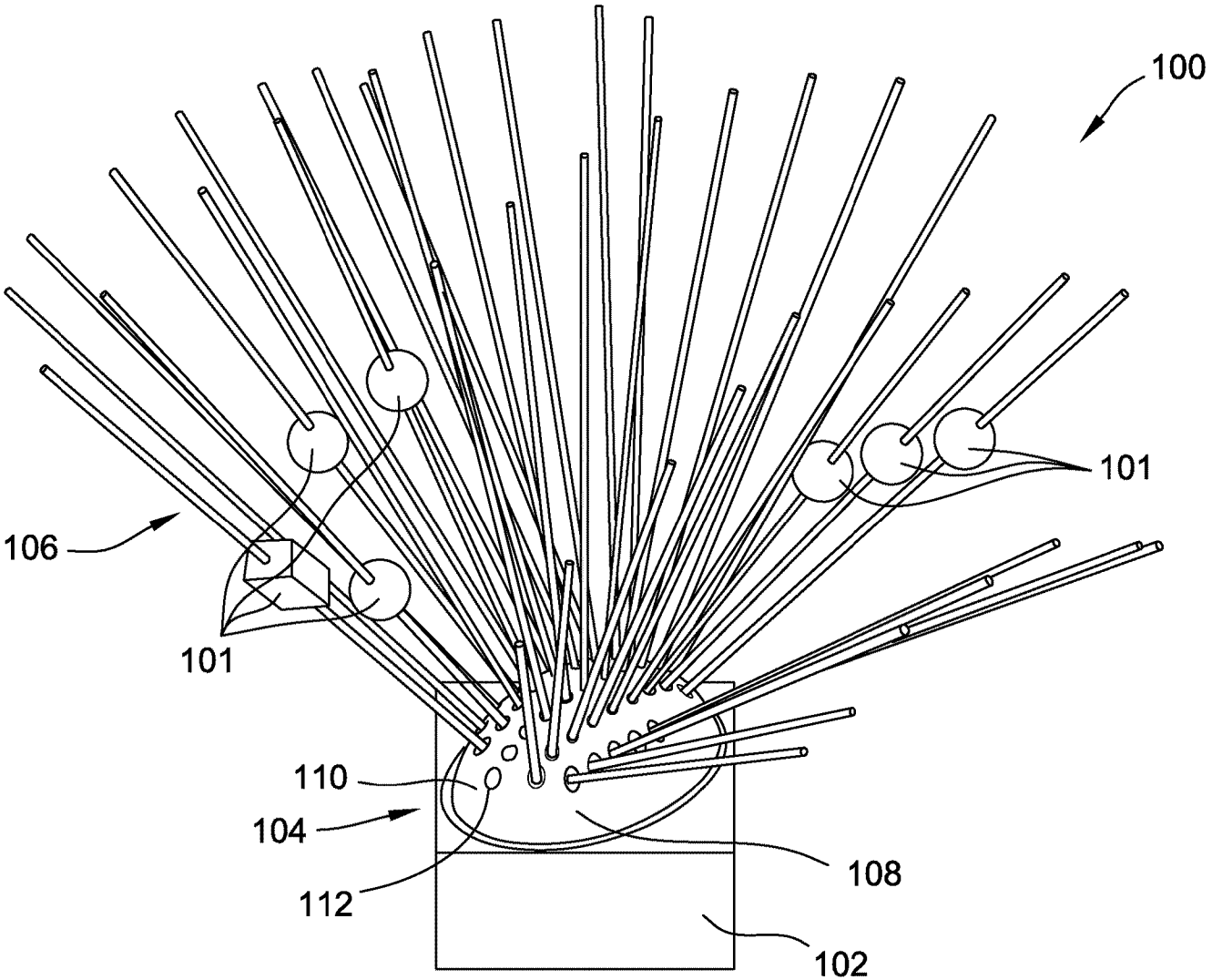
FIG. 1 is a schematic perspective view of a display system.
Figure 2:
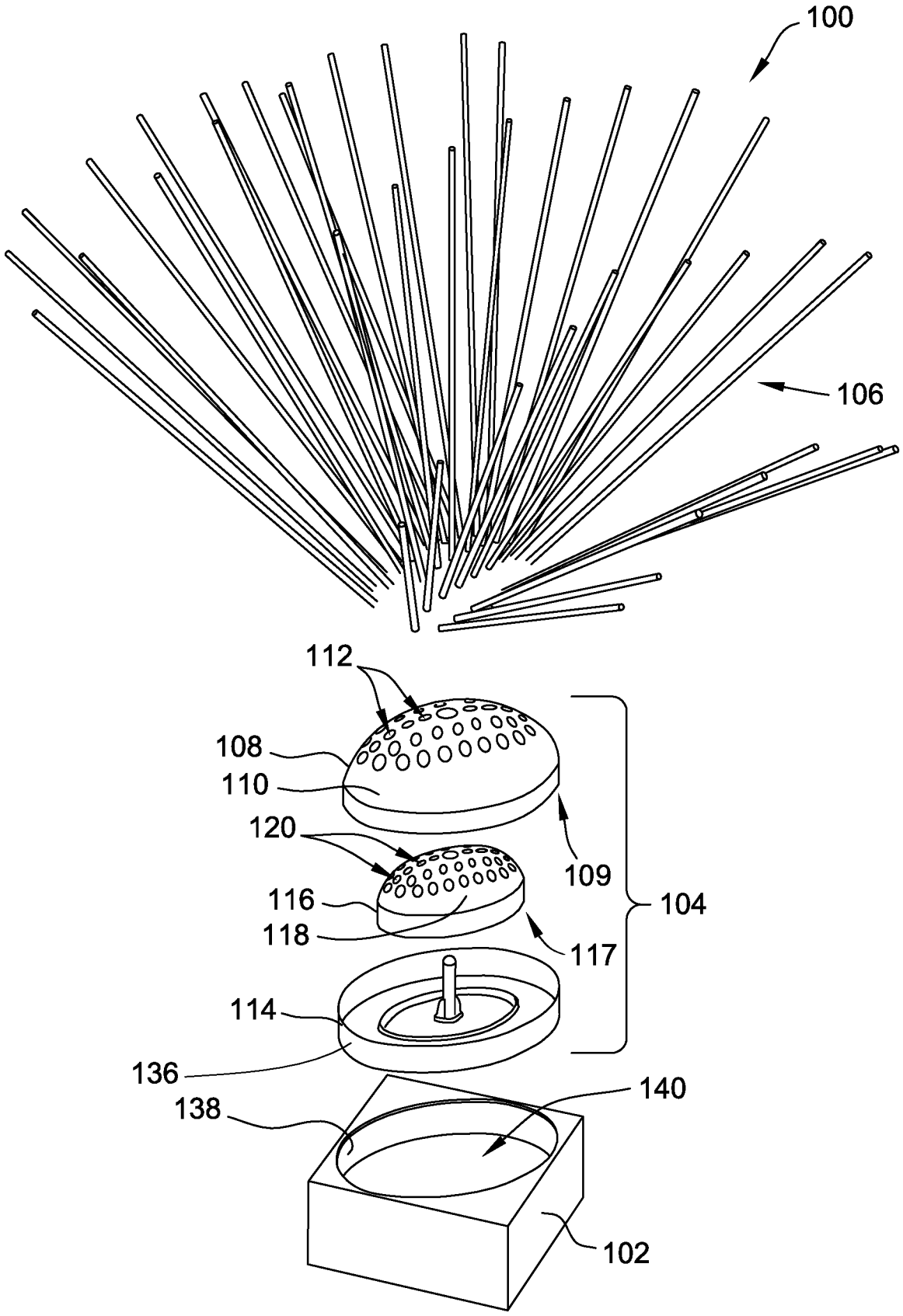
FIG. 2 is a schematic exploded view of the display system shown in FIG. 1.

FIG. 1 is a schematic perspective view of a display system 100 for supporting a plurality of elongate utensils 106. FIG. 2 is a schematic exploded view of the display system 100 shown in FIG. 1. Referring to FIG. 1, in the exemplary embodiment, display system 100 includes a setting platform 102, a shell assembly 104, or more broadly, a display apparatus, and a plurality of elongate utensils 106 supported by, and extending outward from, shell assembly 104. In the exemplary embodiment, setting platform 102 is configured for positioning shell assembly 104 on a display surface (not shown), such as, for example, and without limitation, a table. In the exemplary embodiment, setting platform 102 is generally cubed shape. In alternative embodiments, setting platform 102 is shaped in any manner that enables setting platform 102 to function as described herein. For example, and without limitation, in some alternative embodiments (e.g., as described with respect to FIG. 12) setting platform 102 has a decorative shape to provide a more visually pleasing table display.

In the exemplary embodiment, utensils 106 are food skewers configured to support and display food items 101 such as, for example, and without limitation, meats, cheeses, fruits, seafood, etc. Alternatively, utensils 106 are any suitable elongate utensils and/or are configured to support any suitable item. Utensils 106 are each coupled to, and radiate outward from, shell assembly 104. In particular, in the exemplary embodiment, utensils 106 are coupled to shell assembly 104 such that utensils 106 generally converge as they approach shell assembly 104 and diverge from one another as they extend away from shell assembly 104. In alternative embodiments, utensils 106 are coupled to shell assembly 104 in any manner that enables display system 100 to function as described herein.

Referring to FIG. 2, in the exemplary embodiment, shell assembly 104 includes a base 114, an inner shell 116, and an outer shell 108. Outer shell 108 and inner shell 116 are each configured to be coupled to base 114 with inner shell 116 spaced apart from and at least partially contained within outer shell 108.

In the exemplary embodiment, outer shell 108 includes an outer body 110 defining a plurality of outer openings 112 extending through outer body 110. Outer openings 112 are each sized to slidably receive one of plurality of elongate utensils 106 therethrough. More specifically, in the exemplary embodiment, each utensil 106 of the plurality of utensils 106 is received within one of outer openings 112. In the exemplary embodiment, outer body 110 has a generally semi-ellipsoid shape. In alternative embodiments, outer body 110 has any shape that enables display system 100 to function as described herein.

In the exemplary embodiment, inner shell 116 includes an inner body 118 defining a plurality of inner openings 120 extending through inner body 118. Inner openings 120 are each sized to slidably receive one of plurality of elongate utensils 106 therethrough. More specifically, in the exemplary embodiment, inner body 118 has substantially the same semi-ellipsoid shape as outer body 110, but is reduced in size relative to outer body 110. Inner openings 120 are positioned on inner shell 116 such that each of inner openings 120 is configured to be aligned with a corresponding one of outer openings 112 when inner shell 116 and outer shell 108 are coupled to base 114. In alternative embodiments, inner openings 120 are positioned on inner shell 116 in any manner that enables display system to function as described herein.

Figure 3:
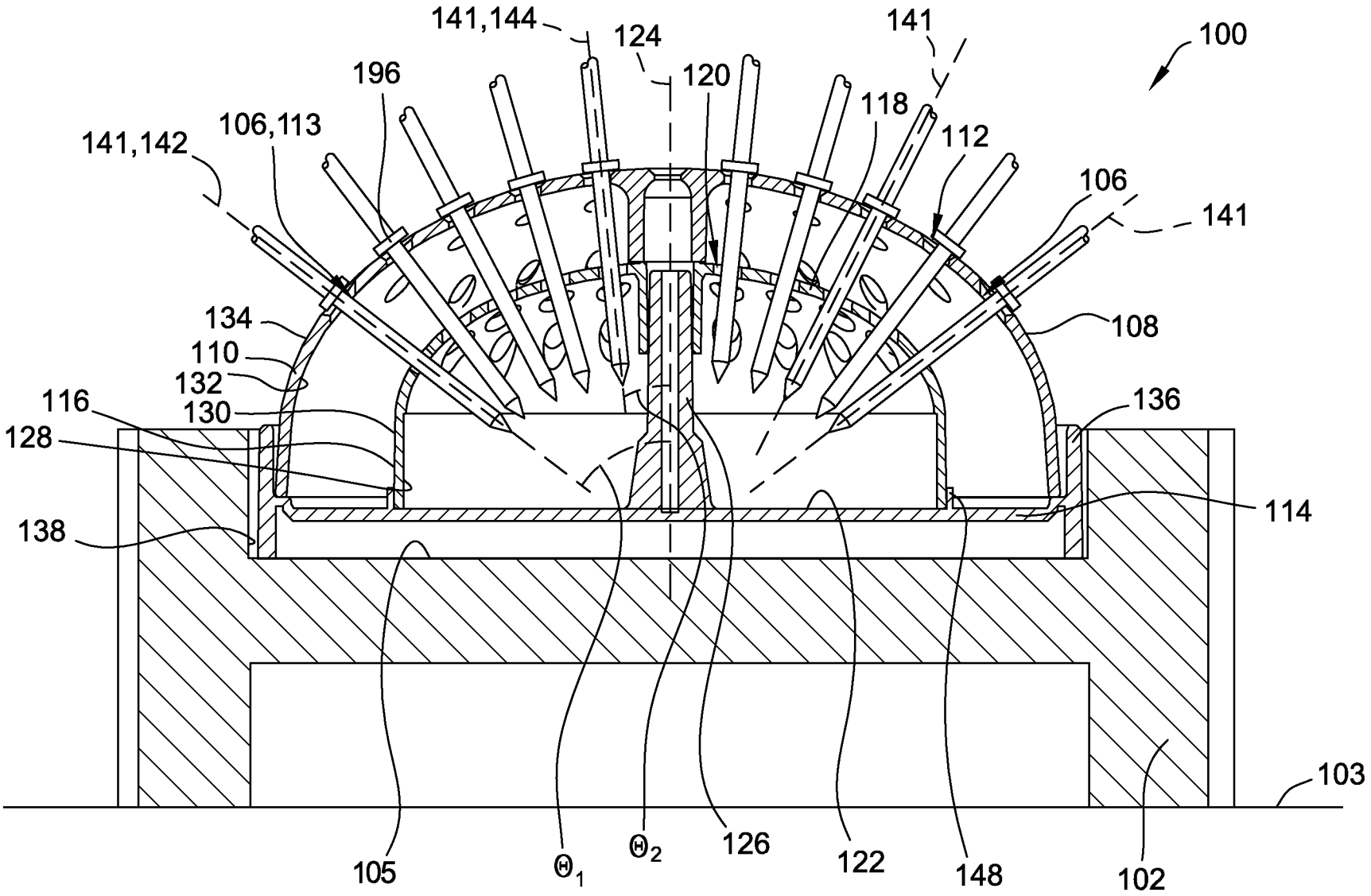
FIG. 3 is a schematic sectional view of the display system shown in FIG. 1.

FIG. 3 is a schematic sectional view of display system 100 shown in FIG. 1. In the exemplary embodiment, base 114 defines a base surface 122 and a longitudinal axis 124 extending normal to base surface 122. Base 114 includes an arm 126 extending longitudinally from base surface 122 and slidably received within at least a portion of inner shell 116 and outer shell 108 to facilitate slidably coupling inner shell 116 and outer shell to base 114.

In the exemplary embodiment, setting platform 102 is positioned on a support surface 103 (e.g., a table top) and extends longitudinally therefrom. In particular, in the exemplary embodiment, base 114 is seated within setting platform 102 such that longitudinal axis 124 is normal to support surface 103. In alternative embodiments, base 114 is seated in setting platform 102 in any manner that enables display system 100 to function as described herein.

In the exemplary embodiment, inner body 118 extends between, and has a thickness defined by, an inner surface 128 and an outer surface 130 of inner shell 116. Outer body 110 extends between, and has a thickness defined by, an inner surface 132 and an outer surface 134 of outer shell 108. In the exemplary embodiment, inner body 118 and outer body 110 are each coupled to base 114 and extend longitudinally therefrom. Inner shell 116 is spaced apart from and contained within outer shell 108. In particular, as described above, in the exemplary embodiment, inner shell 116 is shaped geometrically similar to, and sized to be smaller than, outer shell 108. Outer openings 112 and inner openings 120 are arranged such that, when inner shell 116 and outer shell 108 are coupled to base 114, each outer opening 112 is positioned in alignment with a corresponding inner opening 120 along a corresponding insertion axis 141.

In the exemplary embodiment, shell assembly 104 is removably coupled to setting platform 102. In particular, in the exemplary embodiment, base 114 includes an exterior sidewall 136 extending longitudinally and defining a perimeter of base 114. Setting platform 102 includes a coupling surface 105 and an interior sidewall 138 extending perpendicular to, and at least partially circumscribing, coupling surface 105. Coupling surface 105 and interior sidewall 138 define a recess 140 (shown in FIG. 2) having a perimeter complementary to exterior sidewall 136 and sized to receive base 114 therein in a clearance fit. In particular, base 114 is configured to be received within recess 140 such that (i) base 114 is retained in a set orientation and lateral movement of base 114 relative to setting platform 102 is inhibited, and (ii) shell assembly 104, coupled to and laterally constrained by base 114, extends longitudinally above setting platform 102. In alternative embodiments, display system 100 does not include setting platform 102. For example, and without limitation, in some alternative embodiments, base 114 is positioned on, and in is direct contact with, support surface 103.

In the exemplary embodiment, utensils 106 are each slidably received within one of outer openings 112 and one of inner openings 120 and are arranged such that utensils 106 generally converge towards one another as they extend towards base surface 122, and diverge from one another as they extend outward from outer body 110. Accordingly, utensils 106 are arranged at a variety of different angles with respect to the longitudinal axis 124. For example, in the exemplary embodiment, a first, laterally outermost, utensil 113 is slidably received through a first outer opening 112 and a first inner opening 120 along a first insertion axis 142. First inner opening 120 is aligned with first outer opening 112 along first insertion axis 142 such that first inner opening 120 and first outer opening 112 each extend through inner body 118 and outer body 110, respectively, along first insertion axis 142. First insertion axis 142 is oriented at a first angle $\Theta_1$ relative to longitudinal axis 124. Similarly, a second, laterally inward, utensil 106 is slidably received through a second outer opening 112 and a second inner opening 120 along a second insertion axis 144. Second inner opening 120 is aligned with second outer opening 112 along second insertion axis 144 such that second inner opening 120 and second outer opening 112 each extend through inner body 118 and outer body 110, respectively, along second insertion axis 144. Second insertion axis 144 is oriented at a second angle $\Theta_2$ relative to longitudinal axis 124.

In the exemplary embodiment, first angle $\Theta_1$ is different from second angle $\Theta_2$. More specifically, in the exemplary embodiment, first angle $\Theta_1$ is approximately 45 degrees and second angle $\Theta_2$ is approximately 10 degrees. In alternative embodiments, first angle $\Theta_1$ and second angle $\Theta_2$ are any angle that enables display system 100 to function as described herein. For example, and without limitation, in some alternative embodiments, first angle $\Theta_1$ is at least one of between 80 degrees and 30 degrees and second angle $\Theta_2$ is between 40 degrees and 0 degrees. Other insertion axes 141 may be arranged at various angles, with respect to the longitudinal axis 124, in a range between first angle $\Theta_1$ and second angle $\Theta_2$.

Figure 4:
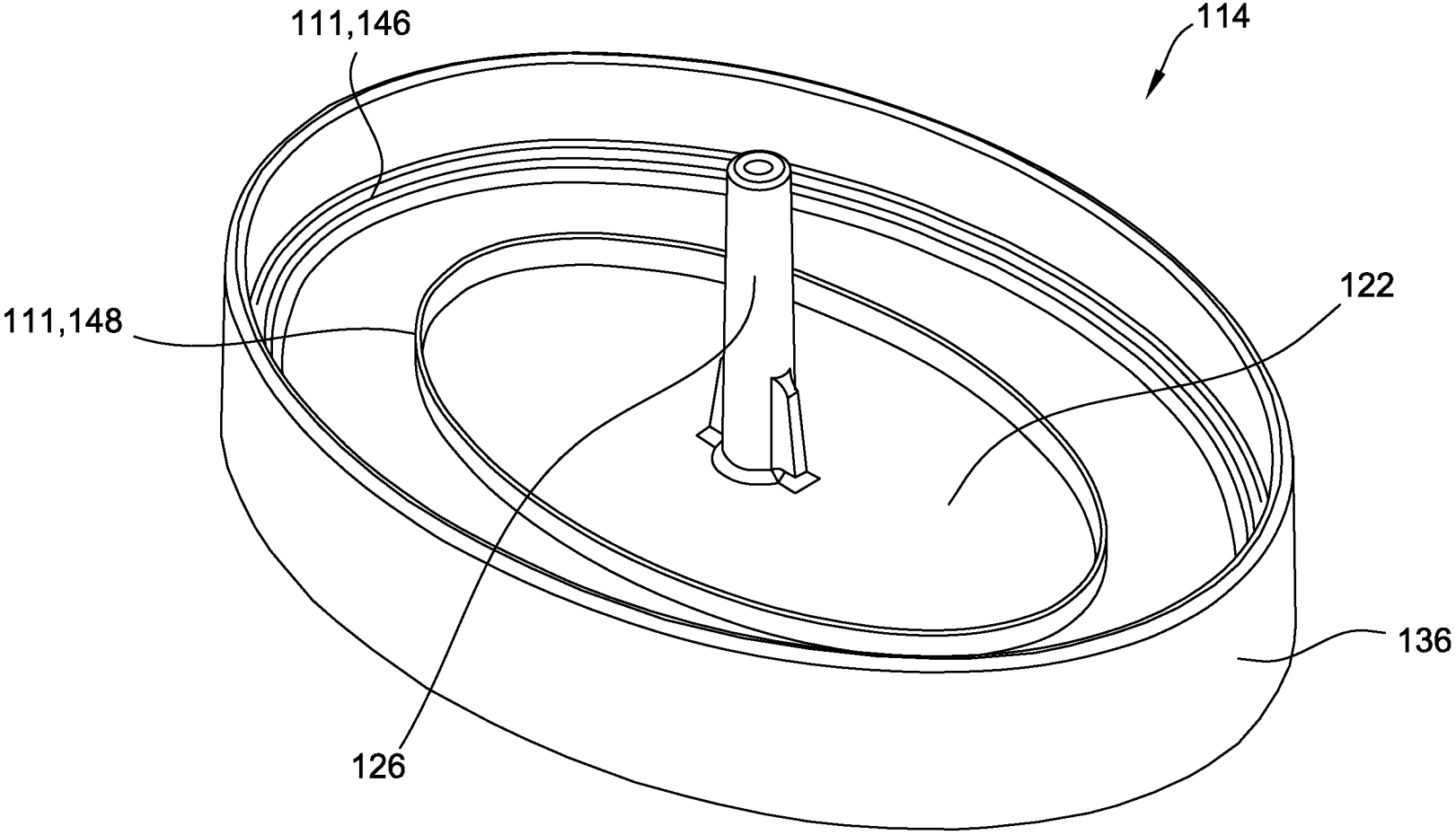
FIG. 4 is a schematic perspective view of an exemplary base for use in the display system shown in FIG. 1.
Figure 5:
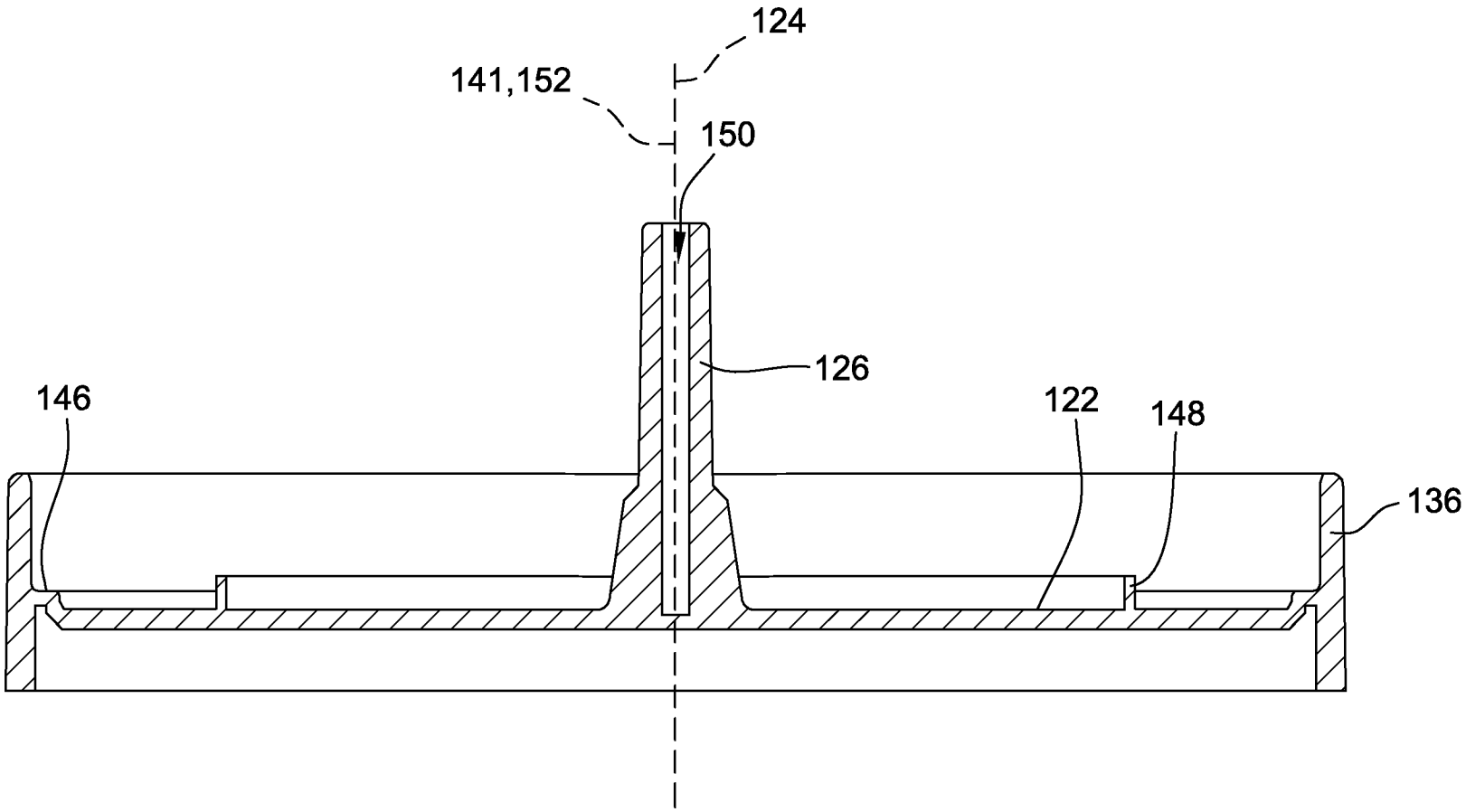
FIG. 5 is a schematic sectional view of the base shown in FIG. 4.

FIG. 4 is a schematic perspective view of base 114 for use in display system 100 shown in FIG. 1. FIG. 5 is a schematic sectional view of base 114 shown in FIG. 4. In the exemplary embodiment, shell assembly 104 includes features 111 that cooperate with inner shell 116 and outer shell 108 to inhibit lateral movement of inner and outer shells relative to base 114. For example, in the exemplary embodiment, base 114 includes a ledge 146 and a ridge 148. Ridge 148 is coupled to base surface 122 and extends longitudinally therefrom. Ridge 148 is sized and shaped complementary to a inner-body perimeter 117 of the inner body 118 (shown in FIG. 2) such that, when inner shell 116 is coupled to base 114, ridge 148 circumscribes and engages the inner-body perimeter 117 to inhibit lateral movement of inner body 118 relative to base surface 122. The inner-body perimeter 117 is generally oval shaped.

In the exemplary embodiment ledge 146 circumscribes base surface 122 and is located adjacent to exterior sidewall 136. Ledge 146 is sized and shaped complementary to a outer-body perimeter 109 of outer body 110 (shown in FIG. 2) such that, when outer shell 108 is coupled to base 114, outer-body perimeter 109 is seated on ledge 146. Exterior sidewall 136 circumscribes ledge 146 and is configured to further engage the outer body perimeter 109 of the outer body 110 (shown in FIG. 3) to inhibit lateral movement of outer body 110 relative to base 114 when outer shell 108 is coupled to base 114. The outer-body 109 perimeter is generally oval shaped. In addition, referring to FIG. 3, ridge 148, ledge 146, and exterior sidewall 136 facilitate orienting inner shell 116 and outer shell 108 relative to one another such that, when inner shell 116 and outer shell 108 are coupled to base 114, each of inner openings 120 are positioned in alignment with outer openings 112, as described above with respect to FIG. 3.

In alternative embodiments, exterior sidewall 136, ridge 148, and ledge 146 are shaped in any manner that enables display system 100 to function as described herein. In still other embodiments, shell assembly 104 includes any suitable features 111 to inhibit lateral movement of inner shell 116 and outer shell 108 relative to base 114. For example, and without limitation, in some alternative embodiments, base 114 does not include ledge 146 and outer shell 108 is configured to seat on base surface 122 when coupled to base 114. In yet further alternative embodiments, base 114 includes a rail (not shown) extending longitudinally and positioned radially inwards of ledge 146 to engage inner surface 128 of outer shell 108 (shown in FIG. 2).

Referring back to FIG. 5, in the exemplary embodiment, arm 126 defines an arm channel 150 sized to slidably receive an elongate utensil 106 (shown in FIG. 3) therein. In particular, as described above, in the exemplary embodiment, arm 126 extends parallel to the longitudinal axis 124 and arm channel 150 is defined within arm 126 to slidably receive one of utensils 106 (shown in FIG. 3) therein along a third insertion axis 152 parallel to the longitudinal axis 124. Alternatively, arm 126 does not include arm channel 150.

Figure 6:
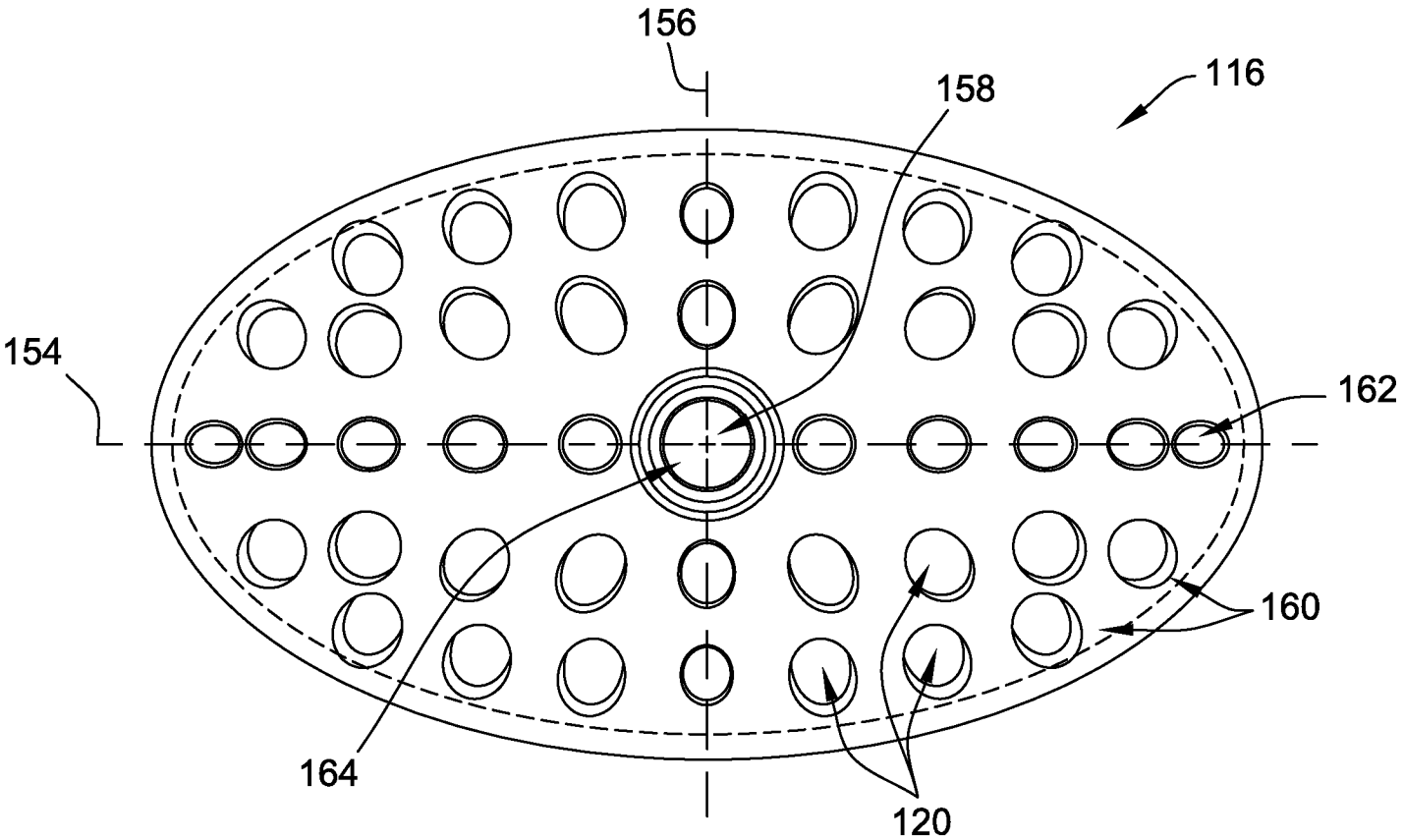
FIG. 6 is a schematic top view of an exemplary inner shell for use in the display system shown in FIG. 1.
Figure 7:
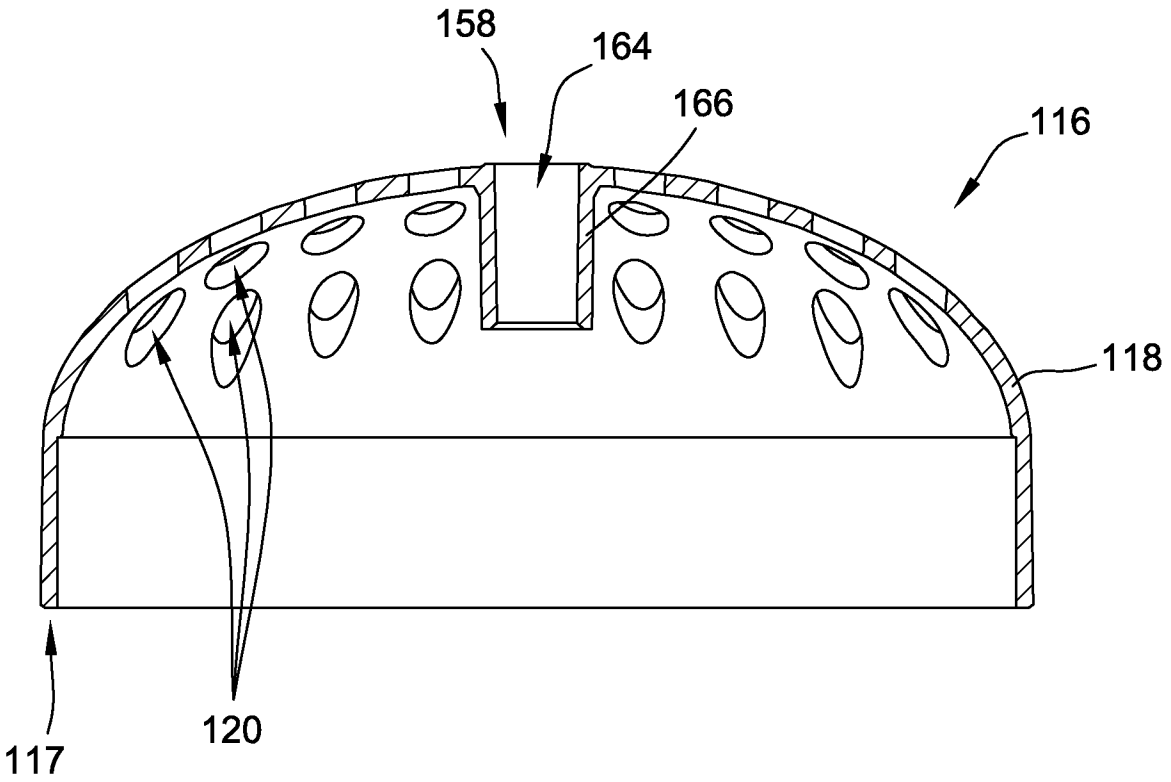
FIG. 7 is a schematic side view of the inner shell shown in FIG. 6.

FIG. 6 is a schematic top view of an exemplary inner shell 116 for use in display system 100 shown in FIG. 1. FIG. 7 is a schematic side view of inner shell 116 shown in FIG. 6. In the exemplary embodiment, inner shell 116 defines a long lateral axis, indicated generally at 154, and a short lateral axis, indicted generally at 156, perpendicular to long lateral axis 154 and intersecting long lateral axis 154 at a center of symmetry, indicated generally at 158. In alternative embodiments, inner shell 116 has any shape that enables inner shell 116 to function as described herein.

In the exemplary embodiment, inner openings 120 are arranged in a plurality of rows 160. In the exemplary embodiment rows 160 are evenly distributed about the long lateral axis 154 such that inner body 118 includes a first row 162 extending generally along the long lateral axis 154 and two rows on each side of long lateral axis 154. In alternative embodiments, inner openings 120 are arranged on inner body 118 in any suitable manner that enables display system 100 to function as described herein.

In the exemplary embodiment, inner body 118 defines a first center channel 164 positioned at the center of symmetry 158 of inner shell 116 and sized to slidably receive arm 126 (shown in FIG. 5) of base 114 therethrough to facilitate slidably coupling inner shell 116 to base 114. In particular, referring to FIG. 7, in the exemplary embodiment, inner shell 116 includes a first center tube 166 that at least partially defines first center channel 164. First center tube 166 depends from inner body 118 at the center of symmetry 158 and extends longitudinally downward therefrom. Alternatively, first center channel 164 is defined entirely by an opening (not shown) extending through inner body 118. In other alternative embodiments, shell assembly 104 does not include first center channel 164 and arm 126.

Figure 8:
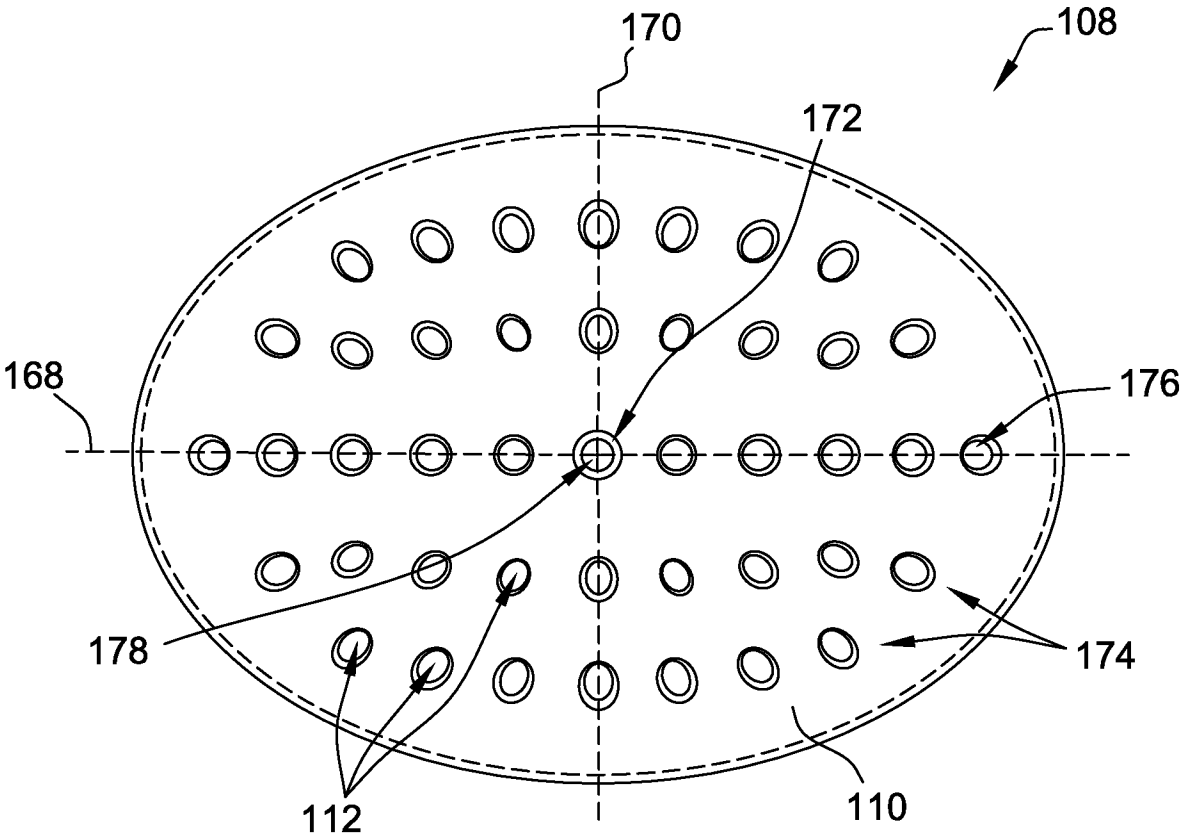
FIG. 8 is a schematic top view of an exemplary outer shell for use in the display system shown in FIG. 1.
Figure 9:
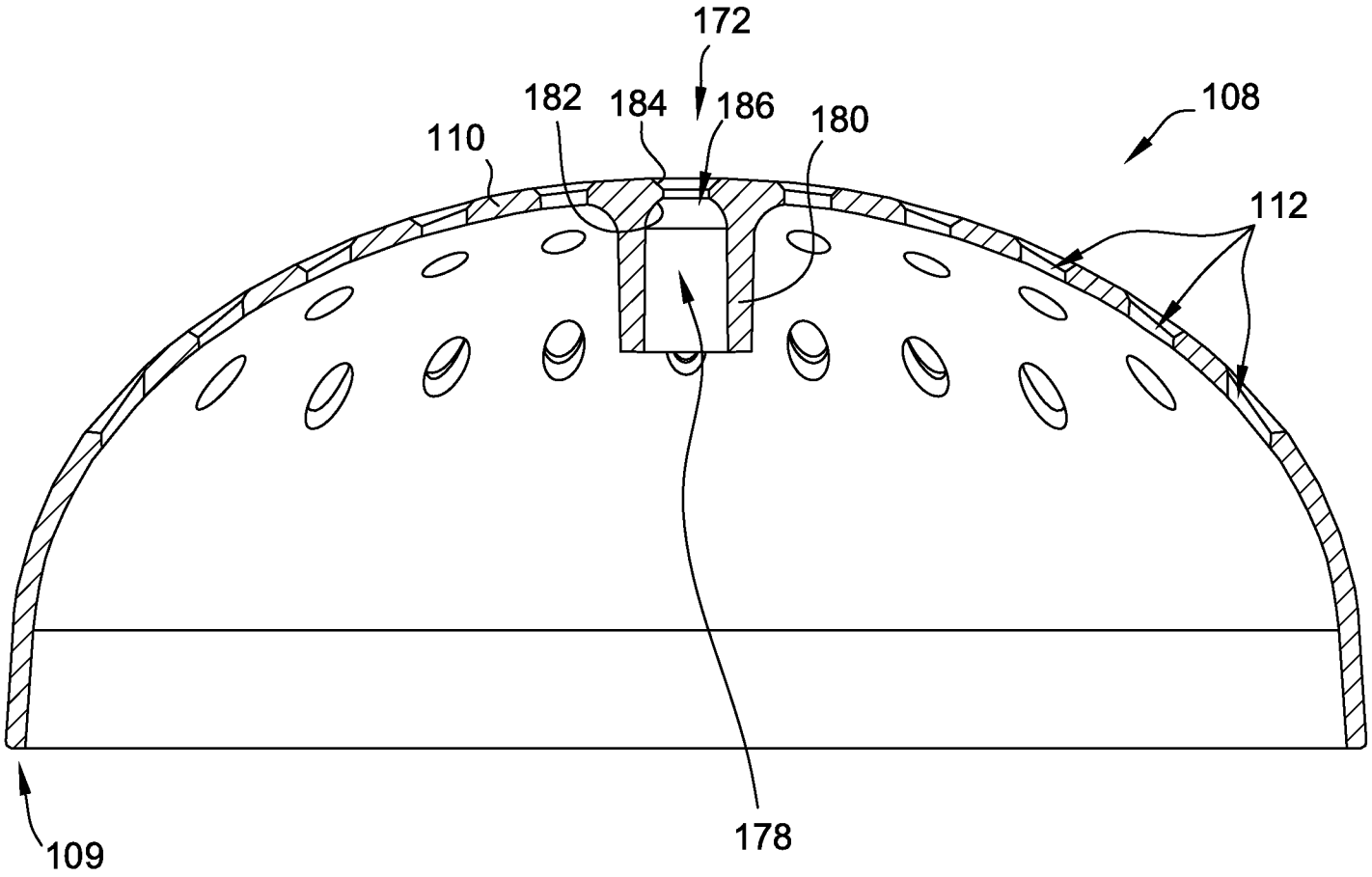
FIG. 9 is a schematic sectional view of the outer shell shown in FIG. 8.

FIG. 8 is a schematic top view of an exemplary outer shell 108 for use in the display system 100 shown in FIG. 1. FIG. 9 is a schematic sectional view of outer shell 108 shown in FIG. 8. In the exemplary embodiment, outer shell 108 defines a long lateral axis, indicated generally at 168, and a short lateral axis, indicted generally at 170, perpendicular to long lateral axis 168 and intersecting long lateral axis 168 at a center of symmetry, indicated generally at 172. In alternative embodiments, outer shell 108 has any shape that enables outer shell 108 to function as described herein.

In the exemplary embodiment, outer openings 112 are positioned in a plurality of rows 174. In the exemplary embodiment rows 174 are evenly distributed about the long lateral axis 168 such that outer body 110 includes a second row 176 extending generally along the long lateral axis 168 and two rows on each side of long lateral axis 168, in correspondence with inner openings 120 (shown in FIG. 6). In alternative embodiments, outer openings 112 are defined in outer body 110 in any manner that enables display system 100 to function as described herein.

In the exemplary embodiment, outer body 110 defines a second center channel 178 positioned at the center of symmetry 158 of outer shell 108 and sized to slidably receive arm 126 (shown in FIG. 5) of base 114 therein to facilitate slidably coupling outer shell 108 to base 114. In particular, referring to FIG. 7, in the exemplary embodiment, outer shell 108 includes a second center tube 180, at least partially defining second center channel 178. Second center tube 180 depends from outer body 110 at the center of symmetry 172 and extends longitudinally downward therefrom. Alternatively, second center channel 178 is defined entirely by an opening defined in outer body 110. In other alternative embodiments, shell assembly 104 does not include second center channel 178 and arm 126.

In the exemplary embodiment, second center tube 180 includes a first tapered region 182 at which second center tube 180 is tapered radially inward. First tapered region 182 is sized to inhibit insertion of arm 126 (shown in FIG. 5) therethrough. In the exemplary embodiment, outer body 110 includes a second tapered region 184 adjacent first tapered region 182. Second tapered region 184 defines a center opening 186 in outer body 110 in flow communication with second center channel 178 and sized to slidably receive a utensil 106 (shown in FIG. 3) therethrough. The second center channel 178 is aligned with the first center channel 164. Second tapered region 184 facilitates guiding a utensil 106 (shown in FIG. 3) received within center opening 186 into arm channel 150 (shown in FIG. 5) when arm 126 is received within second center channel 178.

Referring to FIGS. 6-9, in the exemplary embodiment, inner openings 120 and outer openings 112 are generally circular in cross-section. In alternative embodiments, inner openings 120 and outer openings 112 have any shape that enables inner shell 116 and outer shell 108 to function as described herein, including decorative shapes in some embodiments. For example, and without limitation, in some alternative embodiments, inner openings 120 and outer openings 112 are shaped as at least one of squares, crescents, stars, rectangles, hearts, and diamonds.

Figure 10:
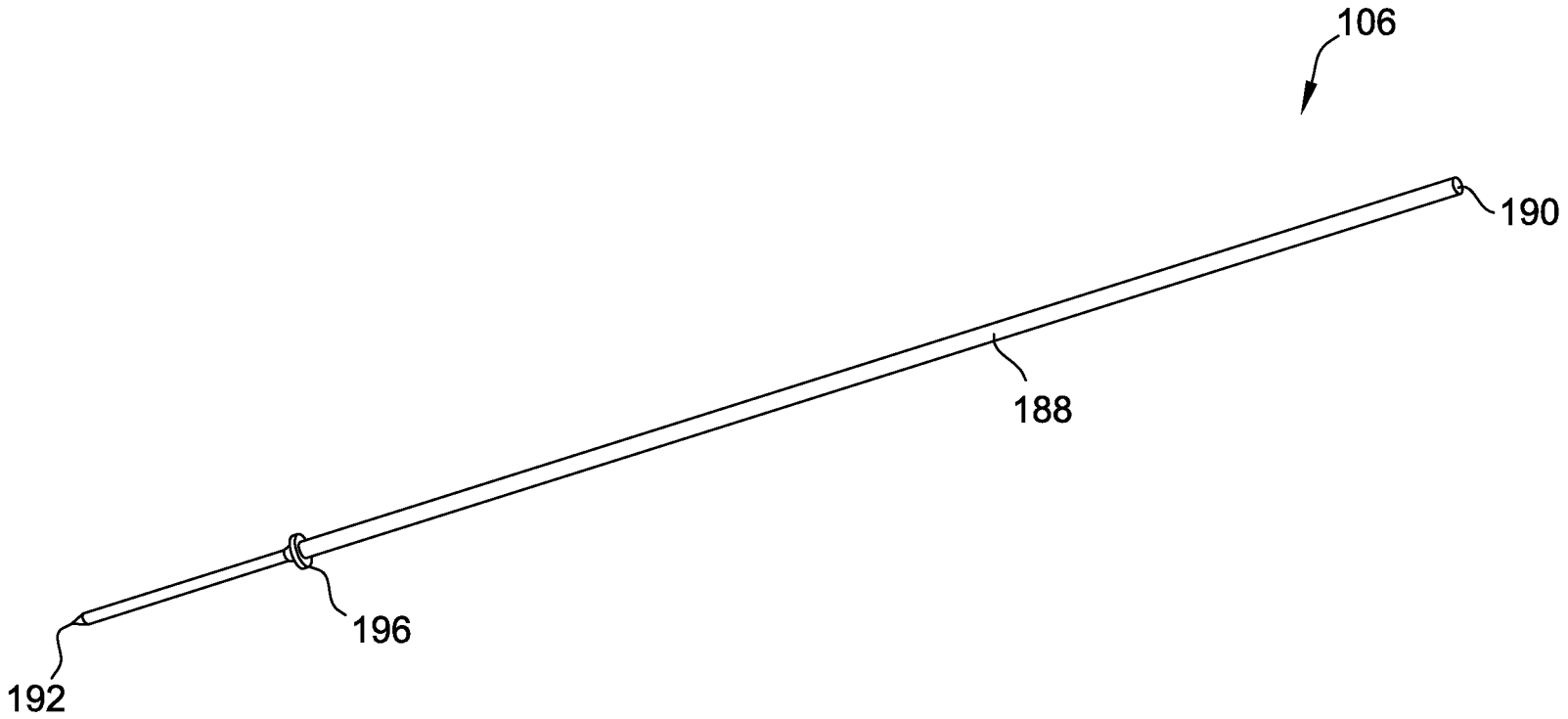
FIG. 10 is a schematic perspective view of an exemplary utensil for use in the display system shown in FIG. 1.

FIG. 10 is a schematic perspective view of an exemplary utensil 106 for use in the display system 100 shown in FIG. 1. In the exemplary embodiment, utensil 106 includes a generally elongate utensil body 188 extending between a grasping end 190, configured to be held by an operator during use, and a skewer end 192. In the exemplary embodiment, utensil body 188 tapers to a pin point at skewer end 192 to facilitate using skewer end 192 to pierce a food item (e.g., meats, cheeses, fruits, seafood, etc.). The skewered item may then be slid along utensil body 188 towards grasping end 190 prior to insertion into shell assembly 104. In alternative embodiments, utensil body 188 is sized and shaped in any manner that enables utensil 106 to operate as described herein.

In the exemplary embodiment, utensil 106 includes a stopper 196 coupled to, and circumscribing, utensil body 188. Stopper 196 is sized to engage outer surface 134 (e.g., as shown in FIG. 3) of outer body 110 when skewer end 192 is inserted into an outer opening 112 and an inner opening 120 to inhibit further insertion of utensil 106 into outer openings 112 of outer body 110. In alternative embodiments, stopper 196 is coupled to utensil body 188 at any position between grasping end 190 and skewer end 192 that enables utensil 106 to operate as described herein.

Figure 11:
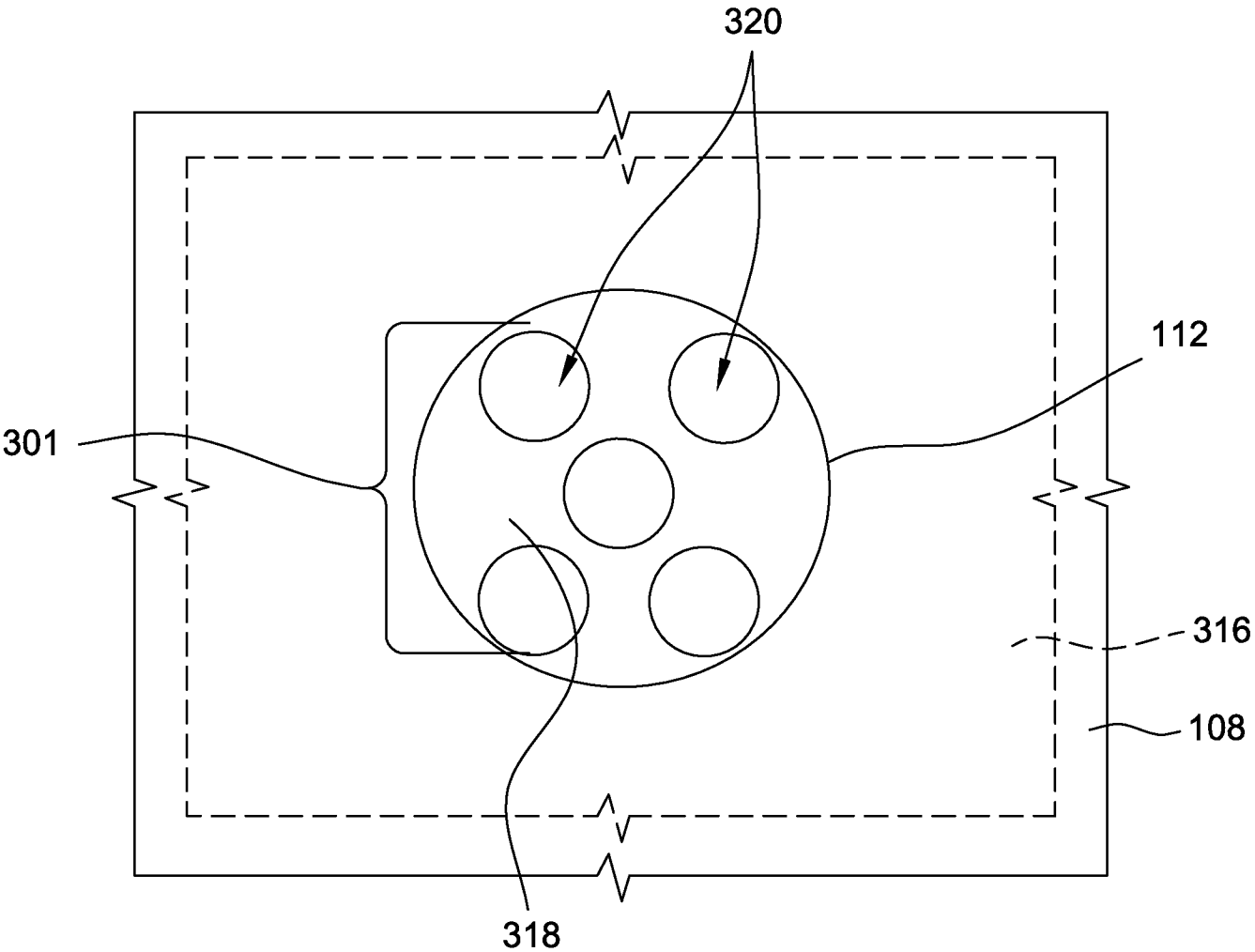
FIG. 11 is a schematic view of a portion of outer shell shown in FIG. 8 and an alternative inner shell for use in the display system of FIG. 1.

FIG. 11 is a schematic view of a portion of outer shell 108 shown in FIG. 8 and an alternative inner shell 316 for use in display system 100 of FIG. 1. In the exemplary embodiment, inner shell 316 is substantially the same as inner shell 116 described above with respect to FIGS. 1-10, except as described below.

In the exemplary embodiment, inner shell 316 includes an inner body 318 defining a plurality of inner openings 320 arranged in clusters 301. More specifically, cluster 301 of inner openings 320 is aligned with a single outer opening 112 defined in outer body 110. For example, in the exemplary embodiment, cluster 301 includes five inner openings 320 arranged in a cross-shaped configuration. Each of the five inner openings 320 are sized smaller than, and aligned with outer opening 112 such that a user may insert an elongate utensil (not shown) through outer opening 112 and into any inner opening 320 of cluster 301.

In the exemplary embodiment, inner shell 316 is configured for use with an alternative utensil (not shown) includes a wide portion, sized to be tightly received within outer opening 112 and a narrow portion, sized for insertion into the smaller inner openings 320 of cluster 301. Though not illustrated, in the exemplary embodiment, inner shell 316 includes a plurality of clusters (not shown), each including five inner openings grouped substantially similar to inner openings 320. Each cluster 301 of the plurality of clusters (not shown) aligns with a respective single outer opening outer opening 112 of outer shell 108 along a respective insertion axis 141. The cluster of multiple openings 320 facilitates an ease of inserting a utensil through the inner shell 316, in that the utensil, after passing through outer shell 108, need only find one of the cluster of closely spaced openings 320 in order to complete insertion. In other words perfect alignment with a single opening is not required. In alternative embodiments, inner shell 116 includes any number of clusters 301, each including any number of inner openings 120 that enables inner shell 316 to function as described herein.

Figure 12:
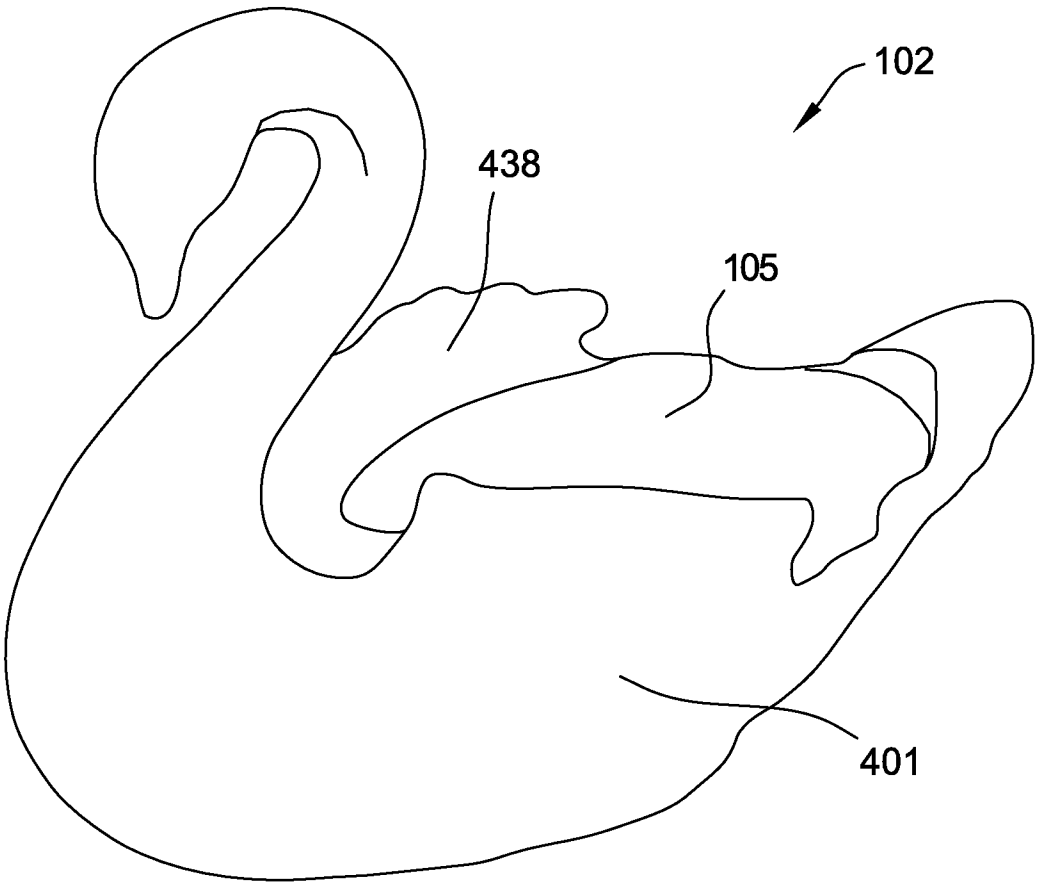
FIG. 12 is a schematic perspective view of an alternative setting platform for use with the display system shown in FIG. 1.
Figure 13:
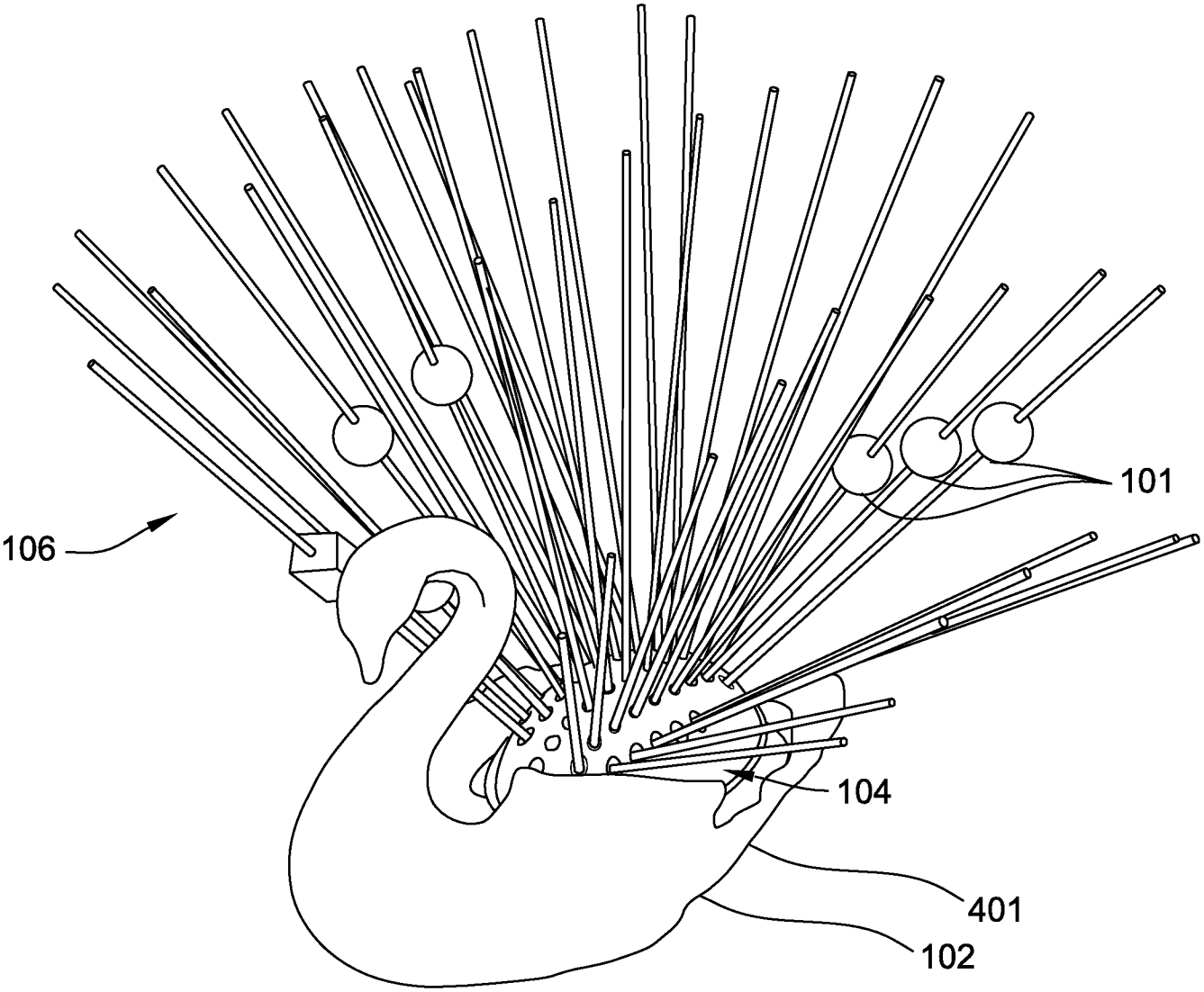
FIG. 13 is a schematic perspective view of the display system shown in FIG. 1 including the alternative setting platform shown in FIG. 12.

FIG. 12 is a schematic perspective view an alternative setting platform 102 for use in display system 100 shown in FIG. 1. FIG. 13 is a schematic perspective view of display system 100 incorporating alternative setting platform 102. In the illustrated embodiment, setting platform 102 includes a decorative shaped exterior surface 401. In particular, in the exemplary embodiment, exterior surface 401 is shaped to resemble a swan. In alternative embodiments, setting platform 102 has any shape that enables setting platform 102 to operate as described herein. For example, and without limitation, in some alternative embodiments, setting platform 102 is shaped to resemble at least one of an animal, a letter or number, a flower, a fruit, a vegetable, a geometric shape, a toy, a ball, and an article. In the exemplary embodiment, setting platform 102 is a substantially hollow shell. In alternative embodiments, setting platform 102 is substantially solid.

In the exemplary embodiment, setting platform 102 again includes coupling surface 105 sized to receive base 114 (shown in FIG. 2) thereon. Additionally, exterior surface 401 further defines an interior side wall 438 that at least partially circumscribes coupling surface 105 and functions similarly to interior sidewall 138 in inhibiting lateral movement of base 114. In alternative embodiments, setting platform 102 further includes another suitable engagement feature (not shown) located adjacent coupling surface 105 and configured to releasably secure base 114 (shown in FIG. 2) to setting platform 102.

Figure 14:
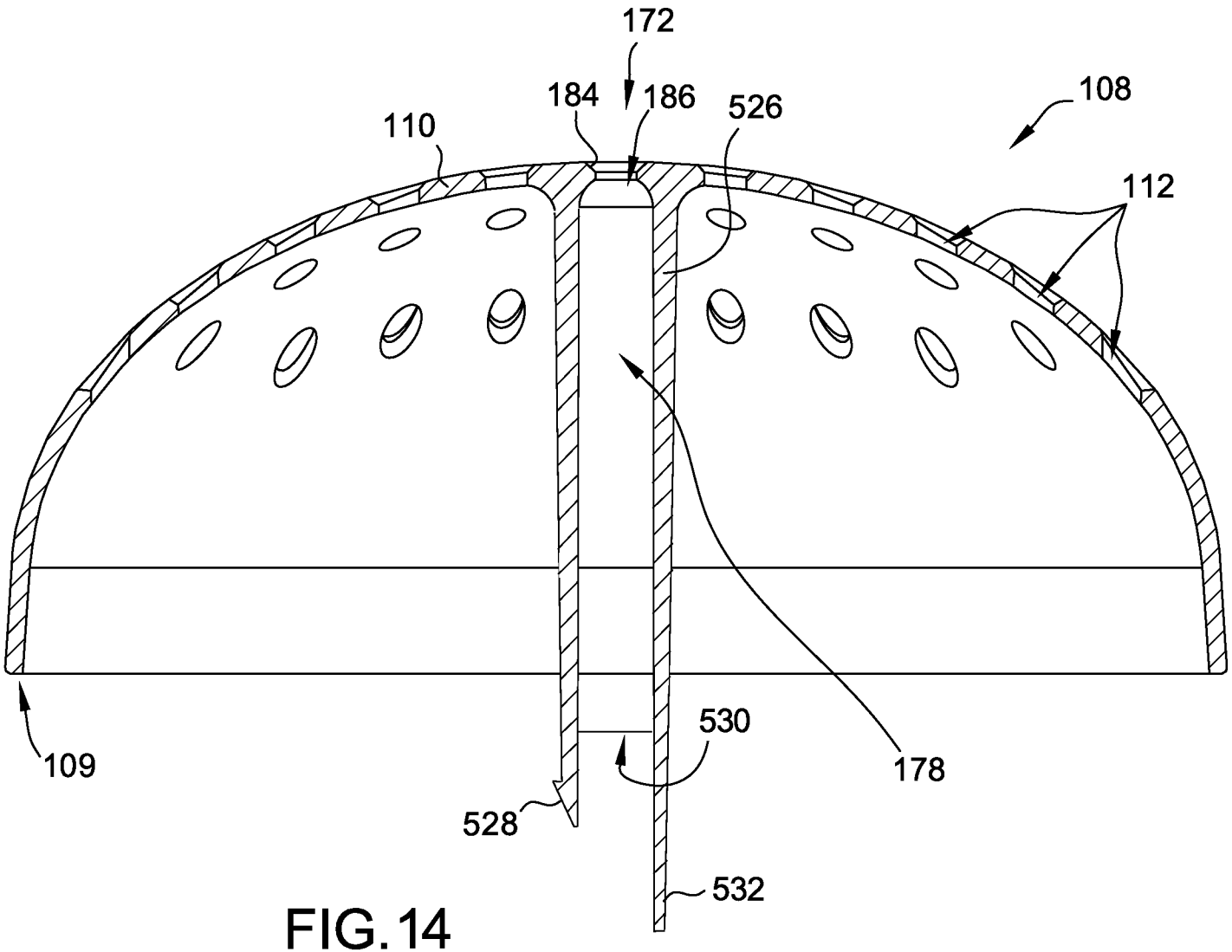
FIG. 14 is a schematic sectional view of an alternative outer shell for use with the display system shown in FIG. 1.
Figure 15:
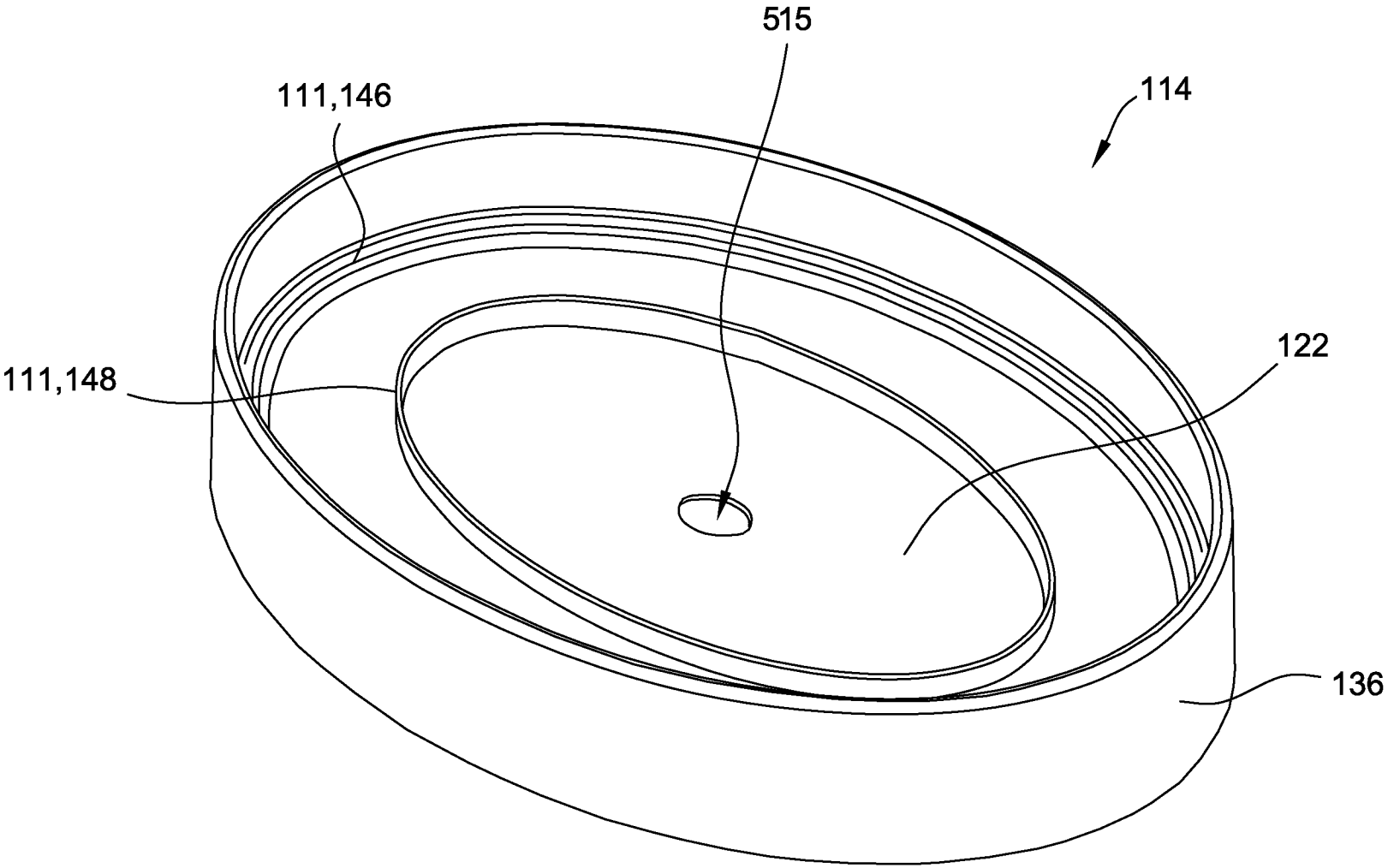
FIG. 15 is a schematic perspective view of another exemplary base for use with the alternative outer shell shown in FIG. 14 in the display system shown in FIG. 1.
Figure 16:
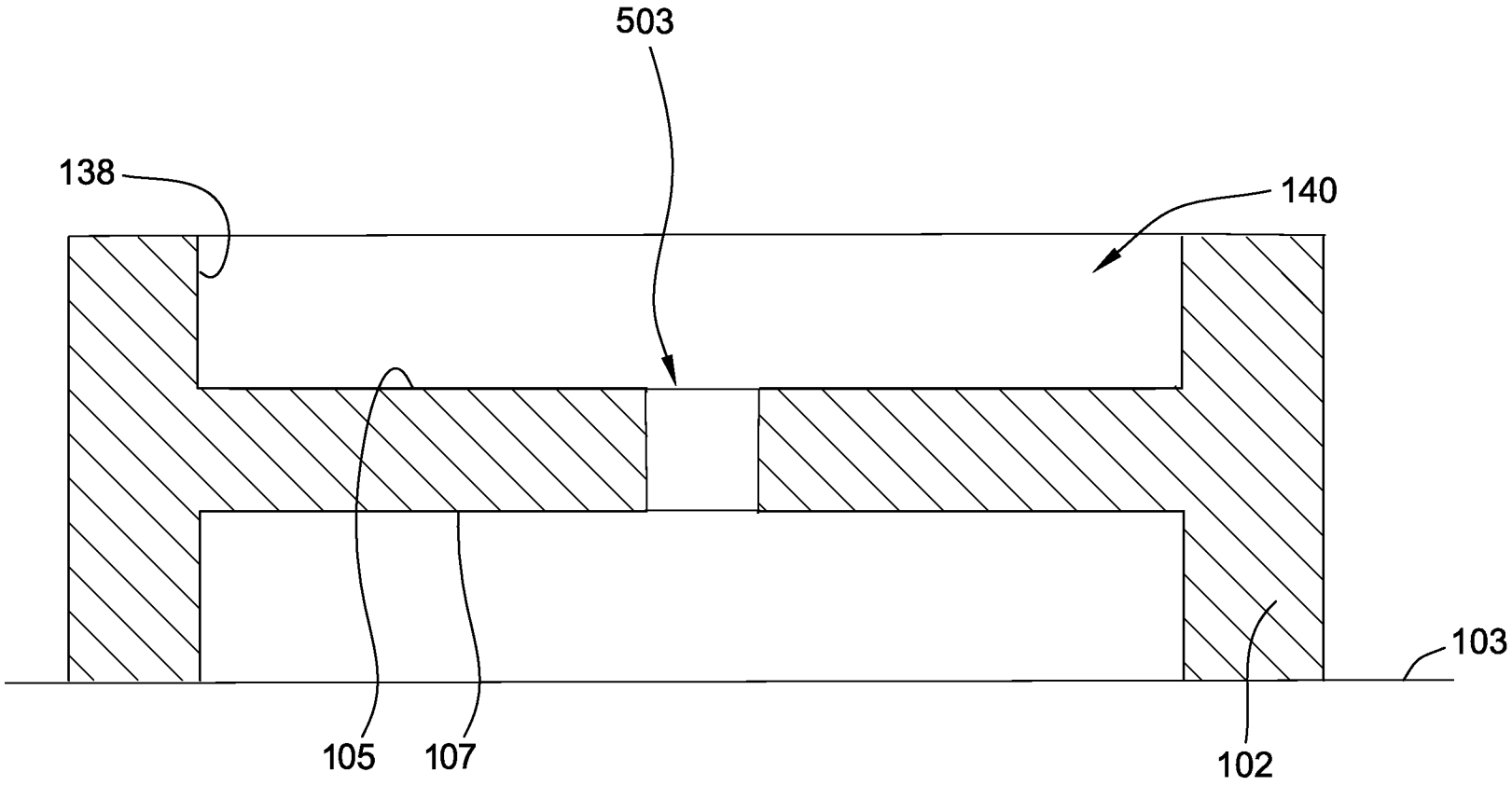
FIG. 16 is a schematic sectional view of another exemplary setting platform for use with the alternative outer shell shown in FIG. 14 in the display system shown in FIG. 1.

FIG. 14 is a schematic sectional view of an alternative outer shell 108 for use with display system 100. FIG. 15 is a schematic perspective view of another exemplary base 114 for use with alternative outer shell 108 shown in FIG. 14, and FIG. 16 is a schematic sectional view of another exemplary setting platform 102 for use with the alternative outer shell 108 shown in FIG. 14. In the illustrated embodiment, base 114 is as described above with respect to FIGS. 4 and 5, except that instead of arm 126, base 114 includes a base opening 515 defined therein and extending therethrough in a direction generally parallel to longitudinal axis 124 (shown in FIG. 3). Similarly, setting platform 102 is as described above with respect to FIG. 3 and/or FIGS. 12 and 13, except that setting platform 102 further includes a setting platform opening 503 extending therethrough from coupling surface 105 to an opposite securing surface 107 in a direction generally parallel to longitudinal axis 124. Finally, outer shell 108 is as described above with respect to FIGS. 8 and 9, except that instead of second center tube 180, outer shell 108 instead includes an arm 526 extending longitudinally downward from outer body 110 generally from center of symmetry 172 and beyond outer-body perimeter 109.

In the illustrated embodiment, arm 526 is configured to extend through first center channel 164 (shown in FIG. 7) of inner body 118 of inner shell 116, and through base opening 515. Moreover, arm 526 includes a locking tab 528 extending longitudinally downward from a distal end 530 of arm 526. Locking tab 528 is configured to resiliently deform to facilitate insertion from top-to-bottom through setting platform opening 503, and, after insertion, to flex back into engagement with securing surface 107 of setting platform 102 to secure shell assembly 104 to setting platform 102. For example, when a user extracts a utensil 106 from shell assembly 104 (both shown in FIG. 1), locking tab 528 engages with securing surface 107 to resist sympathetic movement of shell assembly 104 that may be induced by frictional forces between utensil 106 and outer openings 112. After usage of display system 100, a user may invert display system 100 to access locking tab 528, and push locking tab 528 inward to facilitate disassembly of display system 100 by sliding arm 526 upward away from setting platform 102 and/or base 114. Alternatively, arm 526 does not include locking tab 528.

Further in the illustrated embodiment, arm 526 includes a support tab 532 extending longitudinally downward from distal end 530 of arm 526 opposite locking tab 528. Support tab 532 is configured to extend through setting platform opening 503 into contact with support surface 103 when locking tab 528 is in engagement position with securing surface 107. Accordingly, support tab 532 provides additional support for outer shell 108. Alternatively, arm 526 does not include support tab 532.

Further in the illustrated embodiment, arm 526 is hollow and defines second center channel 178, in flow communication with center opening 186 in outer body 110 and sized to slidably receive a utensil 106 (shown in FIG. 3) therethrough, as described previously. Alternatively, arm 526 is other than hollow and/or does not define second center channel 178, and/or outer shell 108 does not include center opening 186.

In some embodiments, the display system 100 and/or the shell assembly 104 are sold as a kit. For example, in some embodiments, the kit includes a plurality of elongate utensils 106, a base 114, an outer shell 108, an inner shell 116, and at least one setting platform 102, each as described above. The kit may include a plurality of different decorative setting platforms 102 for use on different occasions. In some embodiments, the utensils 106 and/or setting platforms 102 may be sold separately.

Exemplary embodiments of a display system are described above in detail. The systems and methods are not limited to the specific embodiments described herein, but rather, components of systems and/or steps of methods may be utilized independently and separately from other components and/or steps described herein. For example, the display apparatus may also be used in combination with other machines and methods, and is not limited to practice with solely the elongate utensils, food items, and/or setting platforms as described herein. Rather, the embodiments can be implemented and utilized in connection with many other applications.

Although specific features of various embodiments of the disclosure may be shown in some drawings and not in others, this is for convenience only. Moreover, references to "alternative embodiments" in the above description are not intended to be interpreted as excluding the existence of additional embodiments that also incorporate the recited features. In accordance with the principles of the disclosure, any feature of a drawing may be referenced and/or claimed in combination with any feature of any other drawing.

This written description uses examples, including the best mode, to illustrate the disclosure and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A display system for supporting a plurality of elongate utensils, said display system comprising:

a base comprising a flat base surface, an arm extending longitudinally upward from the base surface, and an exterior sidewall that extends longitudinally upward relative to the base surface, the exterior sidewall defines a perimeter of the base, wherein the arm defines a longitudinal axis therethrough and the longitudinal axis is normal to the base surface;

an outer shell comprising a generally semi-ellipsoid shaped outer body, wherein a bottom portion of said outer body defines an enclosed generally oval shaped outer-body perimeter that is coupled to said base, said outer body extends longitudinally from said base along said outer-body perimeter, said outer body comprises a plurality of outer openings therethrough defining a plurality of insertion axes, wherein each outer opening is configured to slidably receive a corresponding elongate utensil from the plurality of elongate utensils therethrough along a respective insertion axis from said plurality of insertion axes, wherein the exterior sidewall of the base is configured to engage and circumscribe the outer-body perimeter to inhibit lateral movement of the outer body relative to the base; and an inner shell comprising a generally semi-ellipsoid shaped inner body, wherein a bottom portion of said inner body defines an enclosed generally oval shaped inner-body perimeter that is coupled to said base, said inner body extends longitudinally from said base along the inner-body perimeter, said inner body is contained within said outer body, said inner body is spaced apart from said outer body, said inner body comprises a plurality of inner openings therethrough, wherein each inner opening is aligned with a corresponding one of the outer openings along each respective insertion axis to slidably receive each corresponding elongate utensil respectively, wherein the plurality of insertion axes are oriented at a plurality of different angles relative to the longitudinal axis.

2. The display system of claim 1, wherein said inner body comprises a first channel that is configured to slidably receive said arm to facilitate slidably coupling said inner shell to said base.

3. The display system of claim 2, wherein said outer body comprises a second channel that is aligned with the first channel of the inner body.

4. The display system of claim 3, wherein said arm defines an arm channel that is configured to slidably receive one elongate utensil from the plurality of elongate utensils along the longitudinal axis.

5. The display system of claim 2, further comprising a setting platform for positioning on a support surface, said setting platform defining a recess that is configured to receive said base.

6. The display system of claim 1 further comprising a setting platform for positioning on a support surface, said setting platform defining a recess that is configured to receive said base.

7. The display system of claim 6, wherein said setting platform comprises an interior sidewall that defines said recess and is shaped complementary to said exterior sidewall of the base.

8. The display system of claim 1, wherein said base comprising a ridge that protrudes upwardly from the base surface, wherein the ridge is configured to engage the inner body to inhibit lateral movement of said inner shell relative to said base.

9. A display system for supporting a plurality of elongate utensils, said display system comprising:

a base comprising a flat base surface, an arm extending longitudinally upward from the base surface, and an exterior sidewall that extends longitudinally upward relative to the base surface, the exterior sidewall defines a perimeter of the base, wherein the arm defines a longitudinal axis therethrough and the longitudinal axis is normal to the base surface;

an outer shell comprising a generally semi-ellipsoid shaped outer body, wherein a bottom portion of said outer body defines an enclosed generally oval shaped outer-body perimeter that is coupled to said base, said outer body extends longitudinally from said base along said outer-body perimeter, said outer body comprises a first outer opening and a second outer opening therethrough respectively, wherein the first outer opening is configured to slidably receive therethrough a first elongate utensil from the plurality of elongate utensils along a first insertion axis, wherein the second outer opening is configured to slidably receive therethrough a second elongate utensil from the plurality of elongate utensils along a second insertion axis, wherein the exterior sidewall of the base is configured to engage and circumscribe the outer-body perimeter to inhibit lateral movement of the outer body relative to the base; and an inner shell comprising a generally semi-ellipsoid shaped inner body, wherein a bottom portion of said inner body defines an enclosed generally oval shaped inner-body perimeter that is coupled to said base, said inner body is contained within said outer body, said inner body extends longitudinally from said base along said inner-body perimeter, said inner body is spaced apart from said outer body, said inner body comprises a first inner opening aligned with the first outer opening along the first insertion axis, wherein the first inner opening is configured to slidably receive the first elongate utensil, said inner body further comprising a second inner opening aligned with the second outer opening along the second insertion axis, wherein the second inner opening is configured to slidably receive the second elongate utensil, wherein the first insertion axis is oriented at a first angle relative to the longitudinal axis and the second insertion axis is oriented at a second angle relative to the longitudinal axis, wherein the first angle is different than the second angle.

10. The display system of claim 9, wherein the first angle is between 80 degrees and 30 degrees and the second angle is between 40 degrees and 0 degrees.

11. The display system of claim 9, wherein said inner body comprises a first channel that is configured to slidably receive said arm to facilitate slidably coupling said inner shell to said base.

12. The display system of claim 11, wherein said outer body comprises a second channel that is aligned with the first channel of the inner body.

13. The display system of claim 12, wherein said arm defines an arm channel that is configured to slidably receive one elongate utensil from the plurality of elongate utensils along the longitudinal axis.

14. The display system of claim 9, further comprising a setting platform for positioning on a support surface, said setting platform defining a recess sized to receive said base wherein said setting platform comprises an interior sidewall that defines said recess and is shaped complementary to said exterior sidewall of the base.

15. The display system of claim 9, wherein said base comprises a ridge that protrudes upwardly from the base surface, wherein the ridge is configured to engage the inner body to inhibit lateral movement of said inner shell relative to said base.

16. A method of assembling a display system for supporting a plurality of elongate utensils, the method comprising the steps of:

providing a base; the base comprises a flat base surface, an arm extending longitudinally upward from the base surface, and an exterior sidewall that extends longitudinally upward relative to the base surface, the exterior sidewall defines a perimeter of the base, wherein the arm defines a longitudinal axis therethrough and the longitudinal axis is normal to the base surface;

providing an outer shell; the outer shell comprises a generally semi-ellipsoid shaped outer body, wherein a bottom portion of said outer body defines an enclosed generally oval shaped outer-body perimeter; said outer body comprises a first outer opening and a second outer opening therethrough, wherein the first outer opening is configured to slidably receive therethrough a first elongate utensil from the plurality of elongate utensils along a first insertion axis, wherein the second outer opening is configured to slidably receive therethrough a second elongate utensil from the plurality of elongate utensils along a second insertion axis;

providing an inner shell; the inner shell comprises a generally semi-ellipsoid shaped inner body, wherein a bottom portion of said inner body defines an enclosed generally oval shaped inner-body perimeter; said inner body comprises a first inner opening aligned with the first outer opening along the first insertion axis, wherein the first inner opening is configured to slidably receive the first elongate utensil, said inner body further comprising a second inner opening aligned with the second outer opening along the second insertion axis, wherein the second inner opening is configured to slidably receive the second elongate utensil, wherein the first insertion axis is oriented at a first angle relative to the longitudinal axis and the second insertion axis is oriented at a second angle relative to the longitudinal axis, wherein the first angle is different than the second angle;

placing the inner body on said base, said inner body extends longitudinally from said base along said inner-body perimeter;

placing the outer-body on said base over the inner-body, said outer body extends longitudinally from said base along said outer-body perimeter, said inner body is contained within said outer body, said inner body is spaced apart from said outer body, wherein the exterior sidewall of the base is configured to engage and circumscribe the outer-body perimeter to inhibit lateral movement of the outer body relative to the base.

* * * * *